United States Patent [19]

Jütte

[11] 3,972,649

[45] Aug. 3, 1976

[54] METHOD OF PERISTALTIC PUMPING AND DEVICE FOR WORKING BY SUCH METHOD

[76] Inventor: Werner Jütte, Gumpendorferstrasse 25/4, 1060 Vienna, Austria

[22] Filed: Oct. 30, 1974

[21] Appl. No.: 519,230

[52] U.S. Cl. ..... 417/53; 417/477

[51] Int. Cl.[2] ..... F04B 43/08; F04B 43/12; F04B 45/06

[58] Field of Search ..... 417/476, 477, 475, 474, 417/53

[56] References Cited

UNITED STATES PATENTS

| | | | |
|---|---|---|---|
| 459,054 | 9/1881 | Traux | 417/477 |
| 3,327,898 | 6/1967 | Farr | 417/476 X |

FOREIGN PATENTS OR APPLICATIONS

| | | | |
|---|---|---|---|
| 4,428,628 | 11/1969 | Japan | 417/477 |
| 2,556 | 10/1866 | United Kingdom | 417/476 |

*Primary Examiner*—Carlton R. Croyle
*Assistant Examiner*—Richard E. Gluck
*Attorney, Agent, or Firm*—Oblon, Fisher, Spivak, McClelland & Maier

[57] ABSTRACT

In pumping devices based on the known principle of peristaltic movement the flexible tube conveying the fluid is regularly advanced while the pump is operating.

In a peristaltic pump working by the aforesaid principle the tube is provided with a prolongation in excess serving as a store length while the tube is fed regularly during operation of the pump.

13 Claims, 3 Drawing Figures

METHOD OF PERISTALTIC PUMPING AND DEVICE FOR WORKING BY SUCH METHOD

In peristaltic pumps a flexible tube is periodically squeezed by clamping elements. The tube is clamped between said elements and a base or anvil surface, the clamping point advancing in the conveying direction. The tube is clamped by said elements at least at two distant points at the same time whereby a closed pump chamber is formed, said chamber advancing in the conveying direction.

Such peristaltic pumps may be designed as rotary pumps having rollers serving as clamping elements. Such elements may be rotatably mounted on a rotating circular disk. Another possible embodiment is a pump designed as a finger pump with a plurality of fingers clamping successively against said tube. A further type is that of a wobble disk pump with the wobble disk squeezing said tube. By all means, clamping is done against a base or anvil surface which may be either a stationary surface or a rotating roll.

In known peristaltic pumps the tube is fixed immovably so that always the same region of the tube is engaged by the clamping elements. As a consequence, a wearing process occurs which alters the output of the pump. Such alteration proceeds gradually, beginning with the operational start of the tube and ending with the replacement of said tube by a new one. Of course, by adjusting the base surface the clamping tightness may be restored, but it is impossible to correct the volumetric capacity which has been changed by the wearing process. Moreover, by adjusting the base surface the stress of the tube is increased which intensifies the wearing process. Such pumps are used quite frequently for the automatization of the analytic chemistry, although they tend to change the conveyed quantity and thus distort the results of the chemical analyses. During its working life the tube loses conveying capacity. The decrease occurs relatively sudden at first, is growing more slowly during a subsequent period, until there again comes a rapid decrease before the tube finally will break.

It is the scope of the invention to avoid this drawback. The invention consists essentially in advancing the flexible tube relative to the base surface, the direction of such advance being preferably identical with the direction of conveying. The feeding of the tube may be continuous and the feeding rate may be a function of the operational time of the pump, or of the advancing velocity of the clamping points. A feeding rate lying within the range of ¾ in. to 8 in. per operational week, and preferably 1¼ in. to 1½ in. (i.e. 2 to 20 cm and 3 to 4 cm, respectively) has been found useful.

Since the tube is continuously fed, those tube portions having the same working age and, consequently, the same degree of wearing, always are positioned in the operative region of the pump. After an initial operating condition starting with a newly inserted tube, a period of normal efficiency will follow as soon as the tube has been advanced through the operational region of the pump. During this working period the volumetric output of the pump remains unchanged. Thus, a pump model is achieved which remains operative during a long period of time without replacement of the tube and which, on the other hand, is characterized by a constant and unchanged output.

The peristaltic pump according to the invention is essentially characterized in that the flexible tube is movably supported and has a prolongation in excess. Said prolongated portion may be wound on a store drum. The rotary speed of said store drum may be controlled in dependence on the working time of the pump or on the number of clamping contacts during a certain period of time. The drum may be continuously rotated. In a preferred embodiment of the invention the drum is driven at a uniform speed by a motor which may be a clock-work, a reduction gear being interposed between said motor and said drum. Alternatively, the drum may be provided with a retarding mechanism, such as a braking device. In this case the drum is rotated by the tension force of the tube. In most cases it is useful to arrange the drum with the prolongated portion of the tube upstream of the pump itself. Of course, such a disposition is necessary if the drum is driven by the tube tension.

The drum may be provided with a helical groove to receive the prolongated portion of the tube. Furthermore, the rotatable drum may be movably supported in an axial direction so that at any time the run-off point of the tube is in appropriate alignment with the feed point of the tube to the clamping mechanism.

Such a drum is capable of receiving a long store portion of the tube. An excess length of, say 1½ to 35 ft can be provided. On the other hand, considering the low feed rate of the tube 3 ft of store length may be sufficient to permit a very long operating period of constant conveying capacity before replacing the tube.

It would be possible to have the drum driven in dependence on the motion of the pump, but with the low feed rate it is less complicated to rotate the drum in constant relation to the time.

In the drawings the invention is schematically illustrated by way of examples. The drawings show a peristaltic pump of the rotary type.

Figure 3:
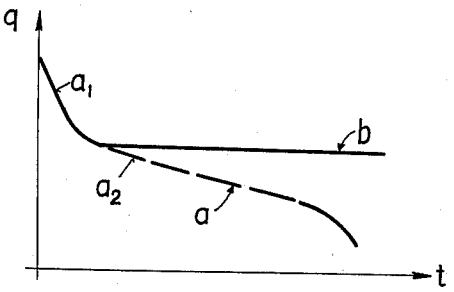

FIG. 3 contains a graph.

Figure 1:
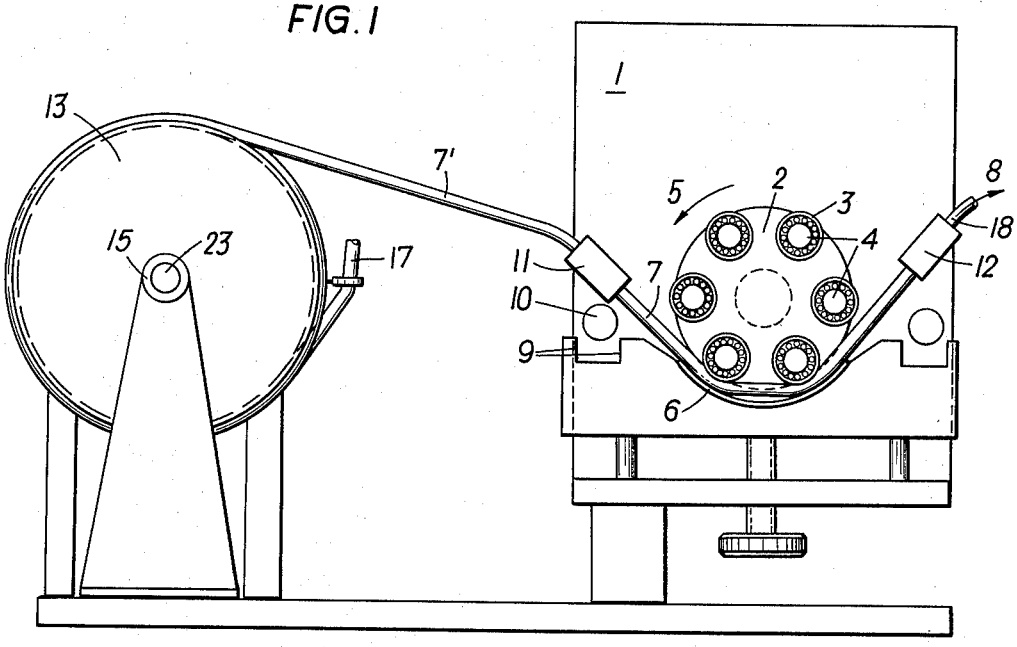
FIG. 1 is a general view.
Figure 2:
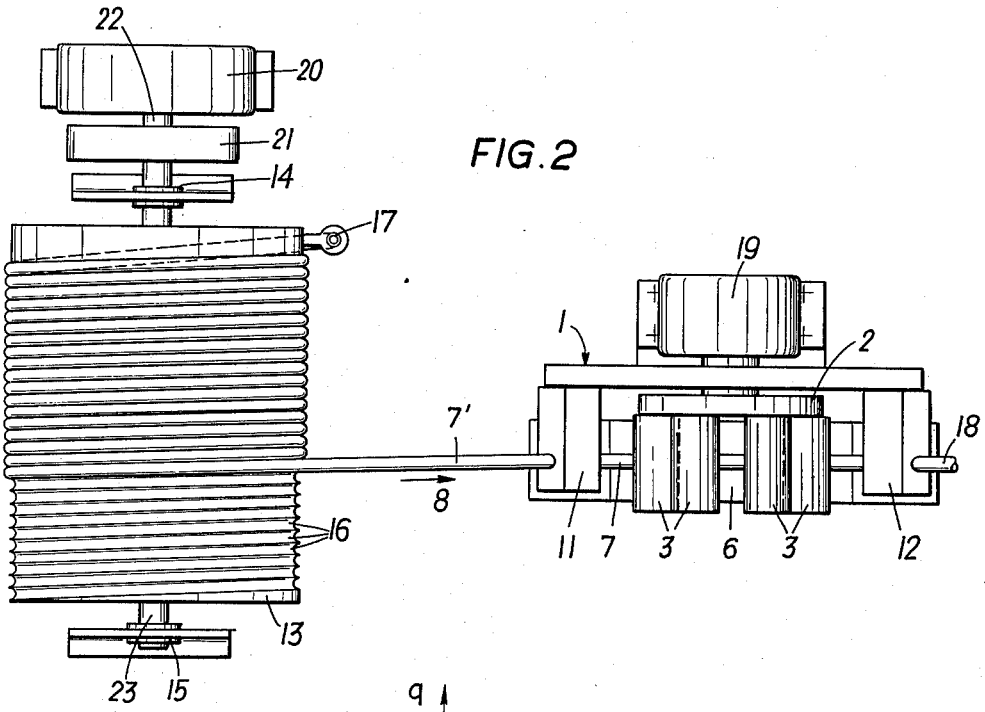
FIG. 2 is a top view of the pump.

In FIG. 1 the peristaltic pump is generally marked as 1. On a front disk 2 there are rotatably mounted rollers 3 turning about axes 4. The front disk 2 is driven in the direction designated by the arrow 5. Between said rollers 3 and a base or anvil surface 6 a flexible tube 7 is guided. The tube is squeezed at any time by two rollers 3 forming between themselves a pump chamber. These chambers proceed in the direction designated by the arrow 8. The driving motor of the pump is designated as 19.

In peristaltic pumps of the prior art the flexible tube was stationary and held between bolts 10 and notched edges 9. According to the invention, the tube 7 is movably inserted, as shown in the drawing, through guide means 11, 12, whilst an excess prolongation of the tube, serving as operational spare portion 7′, is wound about a drum 13. Said drum is rotatably mounted on bearing blocks 14, 15. Each of the guide means 11, 12 is formed as a block with a bore for introducing the tube 7. Of course, these guide means, and particularly the guide 11, through which the tube is to be pulled, may be formed as a roll or a combination of rolls.

The store drum 13 is provided with a helical groove receiving the spare length 7′ of the tube. The end 17 of the tube is fixed, and the fluid to be conveyed is introduced into this intake end. The fluid is conducted in the direction indicated by the arrow 8 as far as the outlet end 18 of the tube 7.

The driving motor 20 of the store drum 13 rotates at a uniform speed. By way of example, a clockwork whose speed is controlled by a balance wheel may serve as a driving motor. Using an electrical clock would be possible, its hour shaft supplying the propulsive power. To further reduce the speed of the drum one may provide a reduction gear 21 between the motor shaft 22 and the drum shaft 23. Since the tube 7 exerts a certain traction force upon the store drum 13 owing to the action of the rollers 3 an extremely low drive power is sufficient for moving the drum. If the traction exerted by the tube is fully sufficient by itself to drive the drum a braking appliance controlling the revolution speed can be provided in the place of the driving motor. For such an appliance again a clockwork could be suitable.

The store drum 13 may be supported movably in axial direction in such a manner that the run-off point of the tube 7' must at any time be in alignment with the guide means 11 in order to avoid any kinking of the tube. The drum shaft may be provided with e.g. a screw thread, the pitch of which being equal to the pitch of the helical groove 16 so that with each revolution the drum travels in an axial direction. In this case the drum may be driven by a hollow shaft. Furthermore, it is possible to provide a plurality of tubes lying side by side as it is well known in the peristaltic pump techniques. If so, there may either be several drums, or there may be one single drum with a multiple-thread grooving.

In the diagram of FIG. 3 the output rate $q$ of the pump is plotted on the ordinate and the duration $t$ of the working time is plotted on the abscissa. The curve $a$ represents the output rate of a pump with a stationary tube. With a new tube the curve at $a_1$ shows a relatively sharp decrease within a first period. Subsequently, in the following period $a_2$ the curve proceeds in a more flat way, i.e. the decrease becomes smaller. Towards the end of the lifetime of the tube, i.e. during the period $a_3$, the curve again shows a sharp decrease down to the point where the tube finally breaks.

However, if the tube is continuously fed as provided by the invention, the output rate will develop in the same manner as described above, only during the first period $a_1$. Beginning at a certain point the rate remains more or less constant, running approximately according to the line $b$ in the graph.

Thus the output rate will decrease during about a first week along the curve $a_1$, and remain then unchanged for many weeks as shown by the line $b$. During this period of time the pump will operate at precision. If the tube is advanced, e.g. ¼ or 1½ in a week, the conveying rate may be held at a constant value through about 30 to 50 weeks after said first week and depending on the store length of the tube.

Although the drawings show a peristaltic pump of the rotary type, it is obvious that the invention is also applicable to finger pumps as well as to wobble disk pumps.

What I claim is:

1. In a method for using the principle of peristaltic movement for conveying a fluid in a peristaltic pump, said pump comprising a flexible tube and clamping elements squeezing said tube periodically against a base surface so as to define clamping points with said base surface, the clamping points travelling in the conveying direction of the fluid to be pumped, the improvement comprising the steps of:

storing an excess portion of said tube upon a rotatable drum; and rotating said drum in a controlled manner and in a direction such that said tube is fed in the axial direction of said tube, and said tube is fed with respect to said base surface and said clamping points with a predetermined feeding rate.

2. The method of claim 1 wherein said tube is fed in respect to said base surface in the conveying direction of the fluid to be pumped.

3. The method of claim 1 wherein said tube is fed continuously and the predetermined feeding rate is determined on the wear rate of the tube.

4. The method of claim 1 wherein said tube is fed continuously and the predetermined feeding rate is determined on the number of clamping contacts during a predetermined period or unit of time.

5. A peristaltic pump comprising:

a flexible tube, claming elements for squeezing said tube periodically against a base surface so as to define clamping points with said base surface, the clamping points travelling in the conveying direction of the fluid to be pumped, said flexible tube having a storage portion movably supported upon storage means for movably supplying said storage portion of said tube to said clamping points, and means for controlling the movement of said storage means and said flexible tube at a predetermined rate.

6. A peristaltic pump as in claim 5, said means for controlling the movement of the flexible tube including a rotatably mounted store drum receiving the storage portion of said tube.

7. A peristaltic pump as in claim 6, wherein said store drum is rotated at a continuous speed.

8. A peristaltic pump as in claim 6 wherein said drum is driven by a uniformly rotating driving motor.

9. A peristaltic pump as in claim 8 wherein said driving motor is a clock work.

10. A peristaltic pump as in claim 8 wherein between said driving motor and said drum a reduction gear is interposed.

11. A peristaltic pump as in claim 6, wherein said drum is arranged upstream of the pump and is provided with a retarding mechanism.

12. A peristaltic pump as in claim 11, wherein said retarding mechanism is a reduction gearing.

13. A peristaltic pump as in claim 6, wherein said drum is provided with a helical groove receiving said storage portion of said tube.

* * * * *